United States Patent [19]

Brochstein

[11] Patent Number: 4,702,143

[45] Date of Patent: Oct. 27, 1987

[54] DRUMSTICK

[75] Inventor: Irwin H. Brochstein, Houston, Tex.

[73] Assignee: Pro-Mark Corporation, Houston, Tex.

[21] Appl. No.: 833,114

[22] Filed: Feb. 26, 1986

[51] Int. Cl.[4] ..... G10D 13/02

[52] U.S. Cl. ..... 84/422 S

[58] Field of Search ..... 84/422

[56] References Cited

U.S. PATENT DOCUMENTS

| | | | |
|---|---|---|---|
| 1,484,096 | 2/1924 | Van Horn | 84/422 S |
| 3,730,570 | 5/1973 | Brochstein | 84/422 S |
| 4,202,241 | 5/1980 | Lucas | 84/422 S |
| 4,300,438 | 11/1981 | Handal | 84/422 S |
| 4,385,544 | 5/1983 | Heiskell | 84/422 S |

*Primary Examiner*—Lawrence R. Franklin

*Attorney, Agent, or Firm*—Bernard A. Reiter; Mark G. Bocchetti

[57] ABSTRACT

An improved drumstick comprising a body and an end, a longitudinal axis extending through said body and said end, a knob means extending from said end and which is engaged by a percussion means fitting thereover, the external dimension of said percussion means when measured laterally through the longitudinal axis being no greater than the lateral dimension of said stick when measured perpendicular to the longitudinal axis, at the point of abutment between the stick and the percussion means so as to facilitate handling of the stick and to enhance the physical durability thereof.

6 Claims, 3 Drawing Figures

DRUMSTICK

BACKGROUND OF THE INVENTION

1. Field of the Invention

This invention relates generally to a drumstick, more particularly it relates to an improved drumstick and to the construction thereof.

2. Description of the Prior Art

It is well known in the art that numerous problems and difficulties are encountered in providing a drumstick that is capable of withstanding the severe abuse which accompanies playing techniques. The inherent percussion which accompanies conventional playing techniques, frequently causes drumsticks to "wear" or it causes the conventional wooden stick to get "soft". Once the stick gets soft, the sound characteristics change. For example, a soft tip produces a "darker" sound, rather than a "brighter" sound. A dark sound is one which is perceived in a more bass mode than in tenor. In order to prolong the life and the fidelity of the sound of a given stick, it is not uncommon among more accomplished drummers to "flip" the stick when the tip gets soft. Also an accomplished drummer may flip the stick to the butt end, from the tip end, in order to obtain a slightly different sound, that is a lower sound on the scale.

In order to reduce the wear resulting from constant percussion, inventors in the prior art have sought numerous alternatives. These have ranged from utilization of harder woods, such as for example, oak to utilization of entirely synthetic sticks and utilization of metallic sticks, such as for example, in U.S. Pat. No. 3,722,350. However accomplished users are familiar with and prefer the weight and feel of wooden sticks over most other synthetic and/or metallic materials. Therefore, the use of wooden sticks having metallic and/or synthetic ends thereon, are not unknown in the art.

The synthetic sticks, such as is taught in U.S. Pat. No. 4,320,688 are not generally preferred and therefore there remains, through the years, the unquestionable conclusion that wooden type sticks meet with uniform favor from percussionists because of the optimum results in sound-producing when striking a drum or cymbal, and because of the feel that is established by the proper distribution of weight. Also, it is believed by many that the flexural characteristics of the wooden type stick could not be duplicated by synthetically formed drumsticks. Moreover, the benefits of wooden drumsticks and the advantages of synthetic materials have not, heretofore, been readily combined on the tip and/or butt end of a wooden stick while enabling "flipping" of the stick from one usage end to the other without encountering a surface obstruction on the stick shaft.

In connection with the above, one may note that percussion instruments are being more commonly employed in contemporary music as more than a means of producing rhythm. The drumsticks are used in a more physical manner causing the normal or typical wooden sticks to not merely wear but to even splinter or break—in periods as short as minutes or hours. Drumsticks having tipped ends of the type have mentioned, are taught in the U.S. Pat. No. 3,301,119 to Gilbert, wherein a drumstick bead 24 is set upon a board stick 23. Such beaded sticks provide obstructions to the hand when the stick is flipped. Also, hollow portions extending through a bead adversely affect the quality of sound production. Similarly, sticks with hollowed interiors into which a bead is fitted are found to wear, if not fracture more easily then solid sticks, due to the absence of substantive body in the shaft at the percussion end.

SUMMARY OF THE INVENTION

The drumstick according to the present invention is comprised preferably of a body portion made of wood, such as oak or hickory, having the configuration and weight distribution of a conventional drumstick made of wood. Either or both ends of the stick are characterized by a recessed shelf, extending at least partially around the circumference of the stick shaft. The recessed shelf terminates in a protrubance or knob extending longitudinally and onto which a nylon or other synthetic tip is frictionally installed. The diameter of the tip is coterminus with the diameter of the stick or shaft so as to facilitate unobstructed flipping of the stick.

DETAILED DESCRIPTION OF THE INVENTION

Figure 1:
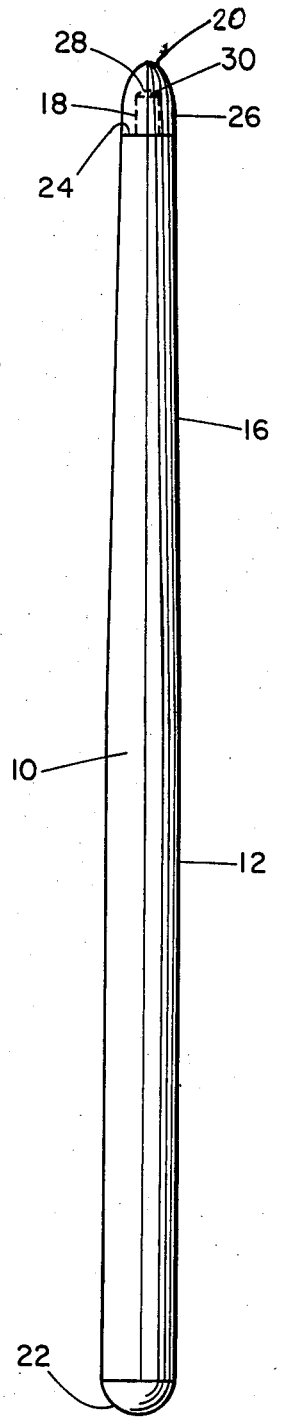
FIG. 1 is a longitudinal cross-sectional view of the drumstick according to the present invention.

The drumstick 10 is provided with a main cylindrical body portion 12 and a tapering intermediate portion resulting in a reduced diameter cylindrical stem portion 16. These portions 12, and 16 are commonly constructed from a singular piece of wood, metal or synthetic material. With particular reference to FIG. 1, there is shown extending from one end of the stick 10 a cylindrical or other knob means 18. The knob means 18 preferably constitutes an integral part of the stick 10 but is characterized by an external diameter of lesser dimension than the stick at the end from which it extends. With reference to FIG. 1, the end from which the knob means 18 extends is the stem 16. The tapered end, herein identified as the end of stem 16 is commonly referred to as the tip end 20 while the opposite end, generally the larger diameter end, is referred to as the butt end. Therefore, the knob means 18 is characterized by an external diameter generally smaller than the end of the stick from which it extends, which in the case of FIG. 1 is the tip end 20. The tip end 20 is characterized therefore by a shelf 24, the radial dimension of which may be described as one-half ($\frac{1}{2}$)×(the tip end diameter—the knob means diameter) at its point of intersection with the shelf 24. The knob means 18 thus in the case of the preferred wooden type stick constitutes an integral part of the stick and extends axially longitudinally therefrom a distance sufficient to enable secure frictional engagement with a percussion means 26. The percussion means 26 may constitute a tubular body opened at one end so as to receive the knob means 18 and closed at the other end. Generally it is rounded and/or somewhat pointed at its external end and in this manner, constitutes a percussion means capable of contact at any point with a percussion surface (not shown). The percussion means 26 is preferably characterized by a concave interior surface 28 and which therefor forms a hollow portion 30. The hollow portion 30 provides a means for producing a mellow tonal quality, not otherwise present, when the stick of the invention is used on a percussion surface. Conversely if it is preferred that the stick of the invention should produce a "harder" or "higher" tonal quality, the interior surface of the percussion means 26 is constructed such that the hollow portion 30 is not present but is instead formed of the same material as the percussion means 26 itself. In either case, the percussion means 26 is adapted to frictionally fit over and engage the knob means 18. Preferably the percussion means 26 is manufactured from a synthetic material, such as for example, nylon. Thus in the manner shown, there is provided a drumstick 10 which, because of the characteristics of the percussion means 26 on the end thereof, is virtually indestructable, is capable of prolonged use and is generally superior to other sticks known and/or in the market place today.

There is further provided a percussion means which is securely affixed to the stick 10 and which is not capable of removal except upon the use of extreme tension force with respect to the stick itself. It is essential to the features and functions of this invention that the diameter of the percussion means 26 be equal to and no greater than the diameter of the stick at the tip end 20 where the percussion means 26 is attached, and further that the thickness of the wall of the percussion means 26 be substantially equal to the depth of the shelf 24 on which it sits. Therefore, in this manner, the external surface of the percussion means 26 is coextensive with the external surface of the stick 10 at the stem section 16 so that there is virtually no detectable difference in service height at the point of contact between these two components. There is therefore virtually no possibility that the percussion means 26 can be physically engaged by hand for removal, nor can it be accidentally hooked onto a protruding edge of a cymbal or drum, or the like in unintentional fashion.

Figure 2:
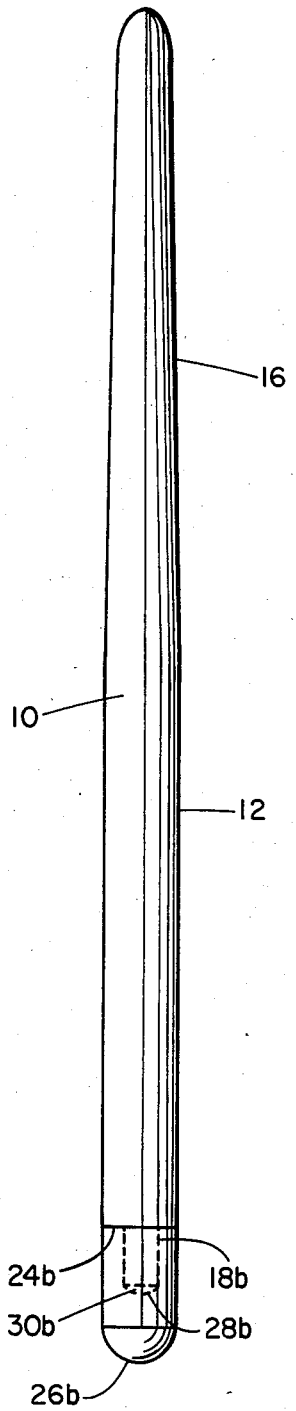
FIG. 2 is a longitudinal cross-sectional view of another drumstick in accordance with the invention.

With respect to FIG. 2, there is shown a construction and modification of the invention of FIG. 1 but wherein, the percussion means **26*b* is affixed to the "butt" end of a stick 10. The attachment itself is accomplished through use of a knob means 18*b* much in the same manner as described with reference to FIG. 1. It may be noted with respect to FIG. 2 and with respect to FIG. 1 that the height of the knob means 18, 18*b* from the shelf 24, 24*b* should be substantially equal to the interior height of the opening in the percussion means 26, measured from the floor of the opening to that point on the interior wall where curvature of the concave interior surfaces 28, 28*b* begins. In this manner, the knob means 18, 18*b*** occupies substantially the entire void, but for the portion thereof that would otherwise constitute the hollow interior above the butt end, should such hollow interior portion be utilized.

Figure 3:
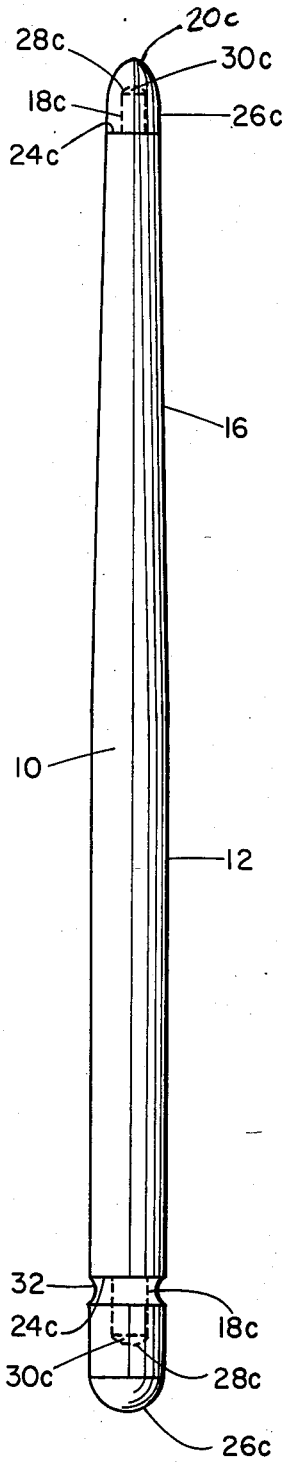
FIG. 3 is yet another longitudinal cross-sectional view of another form of the invention.

With reference to FIG. 3, there is shown yet another form of the invention. In FIG. 3, there is illustrated a stick 10 having a knob means **18*c* extending from each end and on which there is fitted a percussion means 26*c*. In the example of FIG. 3, it should be emphasized that the external diameter of the percussion means 26*c*** at both ends is characterized by the same external diameter of the stick at that point where contact between the two components occurs. This construction enables and facilitates flipping of the stick without interference by any physical protuberance on the stick surface itself and thereby enables utilization of both ends of the stick by a proficient user.

In connection with the various forms of the invention shown here, it is readily visualized that numerous modifications to the concept here disclosed, may be adopted without departing from the spirit and scope of the invention as set forth. For example, the present design of construction facilitates utilization of a colored ring or other identifying indicia. The colored ring, illustrated for exemplary purposes as ring 32 may be characterized by an internal diameter slightly larger than the external diameter of knob means **18*c* and which is adapted to frictionally engage the knob means. A percussion means 26*c* is adapted to fit over the ring means 32 and is affixed to the knob means 18*c* in the manner described heretofore. If preferred, the percussion means 26*c* may be additionally secured to the knob means 18*c*** through the utilization of an adhesive or the like.

Therefore, that which is desired to be secured by United States Letter Patent is:

What is claimed is:

1. An improved drum stick for use with a percussion instrument, the improvement comprising:

(a) a knob means extending from one end of the drum stick, said knob means having a cylindrical diameter less than the cylindrical diameter of the drum stick;

(b) percussion means having an axial bore originating at a proximal end of said percussion means, said percussion means being rounded and solid at a distal end, said knob means being inserted into said axial bore to frictionally engage said percussion means;

(c) an annular shelf at said end of the drum stick from which said knob means extends, the outside diameter of said proximal end of said percussion means being substantially equal to the outside diameter of said annular shelf, said proximal end of said percussion means abutting said shelf, the diameter of said percussion means being greatest at said proximal end.

2. An improved drum stick for use with a percussion instrument as recited in claim 1, the improvement further comprising:

(a) a second knob means extending from a second end of the drum stick, said second knob means having a cylindrical diameter less than the cylindrical diameter of the drum stick;

(b) a second percussion means having an axial bore originating at a proximal end of said second percussion means, said second percussion means being rounded and solid at a distal end, said second knob means being inserted into said axial bore to frictionally engage said second percussion means;

(c) a second annular shelf at second end of the drum stick from which said second knob means extends, the outside diameter of said proximal end of said second percussion means being substantially equal to the outside diameter of said second annular shelf, said proximal end of said second percussion means abutting said second shelf, the diameter of said second percussion means being greatest at said proximal end.

3. An improved drum stick for use with a percussion instrument as recited in claim 2, the improvement further comprising:

ring means have a central bore, the diameter of said central bore being substantially equal to the diameter of said second knob means, said ring means being positioned about said second knob means between said second annular shoulder and said second percussion means.

4. An improved drum stick for use with a percussion instrument as recited in claim 1, the improvement further comprising:

a first void located between said knob means and said percussion means in close proximity to the distal end of said percussion means.

5. An improved drum stick for use with a percussion instrument as recited in claim 4, the improvement further comprising:

a second void located between said second knob means and said second percussion means in close proximity to said distal end of said second percussion means.

6. An improved drum stick for use with a percussion instrument, the improvement comprising:

(a) a knob means extending from each end of said drum stick, each of said knob means having a cylindrical diameter less than the cylindrical diameter of said drum stick;

(b) percussion means having an axial bore originating at a proximal end of said percussion means, said percussion means being rounded and solid at a distal end, said knob means being inserted into said axial bore to frictionally engage said percussion means;

(c) an annular shelf at each end of said drum stick from which said knob means extend, the outside diameter of said proximal end of each of said percussion means being substantially equal to the outside diameter of said annular shelves, said proximal ends of said percussion means abutting said shelves, the diameter of said percussion means being greatest at said proximal ends.

* * * * *